US008925132B1

(12) United States Patent
Quinonez et al.

(10) Patent No.: US 8,925,132 B1
(45) Date of Patent: Jan. 6, 2015

(54) BRIDGE STRUCTURE AND METHOD

(71) Applicant: Manhattan Road and Bridge Company, Oklahoma City, OK (US)

(72) Inventors: Gerardo Quinonez, Moore, OK (US); Stuart Mack Ronald, Ada, OK (US); Christopher C. E. Ramseyer, Norman, OK (US)

(73) Assignee: Manhattan Road and Bridge Company, Oklahoma City, OK (US)

( * ) Notice: Subject to any disclaimer, the term of this patent is extended or adjusted under 35 U.S.C. 154(b) by 0 days.

(21) Appl. No.: 14/055,378

(22) Filed: Oct. 16, 2013

(51) Int. Cl.
*E01D 21/00* (2006.01)
*E01D 2/02* (2006.01)
*E01D 101/28* (2006.01)

(52) U.S. Cl.
CPC *E01D 2/02* (2013.01); *E01D 21/00* (2013.01); *E01D 2101/285* (2013.01)
USPC ..... 14/77.1; 14/73; 14/74.5

(58) Field of Classification Search
CPC ..... E01D 21/00; E01D 2101/30; E01D 2/02
USPC ..... 14/74.5, 77.1, 73
See application file for complete search history.

(56) References Cited

U.S. PATENT DOCUMENTS

| | | | | | |
|---|---|---|---|---|---|
| 416,054 | A | * | 11/1889 | Clymer | 14/74.5 |
| 430,304 | A | * | 6/1890 | Smith | 14/74.5 |
| 811,257 | A | * | 1/1906 | Strauss | 52/319 |
| 1,133,230 | A | * | 3/1915 | Funk | 14/74.5 |
| 1,472,055 | A | * | 10/1923 | Drake | 14/74.5 |
| 1,646,476 | A | * | 10/1927 | Cumpston et al. | 14/74.5 |
| 4,042,991 | A | * | 8/1977 | Macy et al. | 14/77.1 |
| 5,335,386 | A | | 8/1994 | Newell | |
| 7,373,760 | B2 | | 5/2008 | Tokuno et al. | |
| 7,461,427 | B2 | | 12/2008 | Ronald et al. | |

OTHER PUBLICATIONS

Bridge Construction Overview, unknown author, 2008, and admitted to be prior art.

US Dept of Transportation, Federal Highway Administration, Steel Bridge Design Handbook, Bracing System Design, Publication No. FHWA-IF-12-052-vol. 13, pp. 14-25, Nov. 2012.

* cited by examiner

*Primary Examiner* — Raymond W Addie
(74) *Attorney, Agent, or Firm* — McAfree & Taft

(57) ABSTRACT

A system for tension bracing a series of spaced girders forming a part of a bridge which includes a lateral member extending across the tops of the series of spaced girders. A first end of the lateral member is attached to a first girder in the series of spaced girders. A second end of the lateral member engages an adjustable mount, which is affixed to the last girder in the series of spaced girders. The adjustable mount adjusts the tension in the lateral member and, once a predetermined tension is reached, the lateral member is affixed to the intermediate girders in the series of spaced girders.

18 Claims, 4 Drawing Sheets

BRIDGE STRUCTURE AND METHOD

FIELD

The present invention relates to bridges and in particular to steel span bridges and the bracing of girders forming a part thereof.

BACKGROUND

Bracing systems serve a number of important roles in bridges. Braces provide stability to the primary girders as well as improving the lateral or torsional stiffness and strength of the bridge system both during construction and in service. One type of bracing is top or bottom lateral bracing (a relative brace system), which may be needed as temporary bracing during construction. In steel I-beam or I-girder bridges, lateral bracing generally is placed either in or near the plane of the flange being braced. The lateral bracing helps to prevent lateral movement of the structural system during construction. Flange level lateral bracing may also be needed in deck replacement projects on long span bridges. In the final condition, the concrete deck can typically resist lateral wind loads and prevent significant horizontal movement of the structure. However, if the deck requires replacement and is removed, lateral deflections can be excessive in long span bridges without lateral bracing. Essentially, a lateral bracing system will stiffen a structure significantly, as compared to one without any lateral bracing.

SUMMARY

In one embodiment there is provided a method of tension bracing a bridge comprising:

attaching a first end of a lateral member to a first girder in a series of spaced girders having a first girder, a last girder and at least one intermediate girder spaced laterally between the first girder and the last girder, wherein each girder has a top for supporting a decking and a bottom;

attaching an adjustable mount to the last girder wherein the adjustable mount engages a second end of the lateral member such that tension can be applied to the lateral member;

adjusting the adjustable mount to apply a predetermined tension to the lateral member; and attaching the lateral member to each of the intermediate girders.

In another embodiment there is provided a bridge structure comprising a series of spaced girders, an adjustable mount and a lateral member. The series of spaced girders have a first girder, a last girder, and at least one intermediate girder spaced laterally between the first girder and the last girder. Each girder has a top for supporting a decking and a bottom. The adjustable mount is affixed to the top of the last girder. The lateral member extends across the tops of the series of spaced girders. The lateral member has a first end affixed to the top of the first girder and a second end engaging the adjustable mount such that the adjustable mount can adjust the tension in the lateral member.

DETAILED DESCRIPTION

Figure 1:
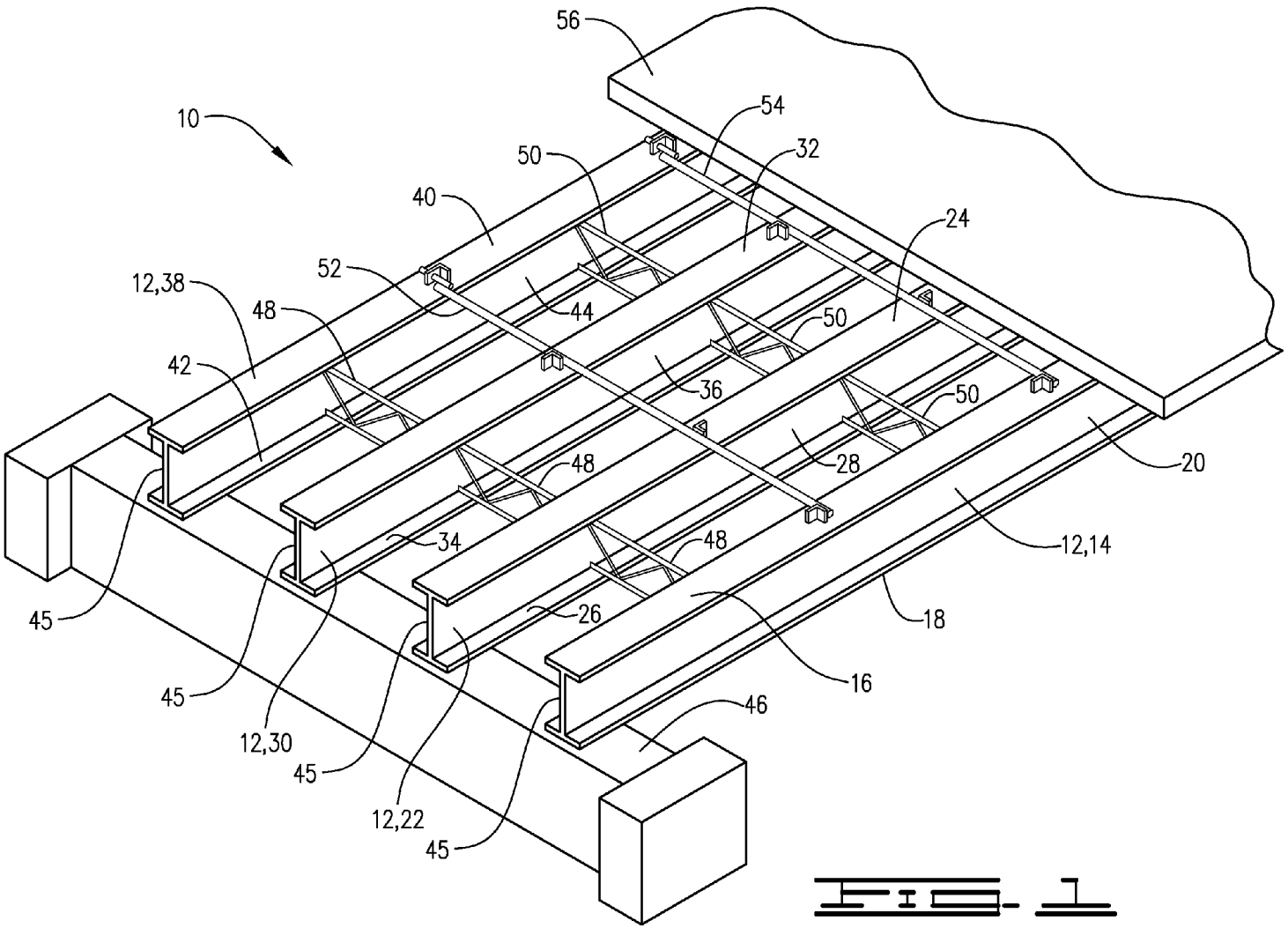
FIG. 1 is a perspective schematic view of a portion of a span of a simple span bridge structure with lateral bracing.

Embodiments of a bridge structure will be described hereinafter with reference to FIGS. 1 through 4. In the description that follows, like parts are marked throughout the specification and drawings with the same reference numerals. The drawings are not necessarily to scale and the proportions of certain parts have been exaggerated to better illustrate details and features of the invention. Where components of relatively well known designs are employed, their structure and operation will not be described in detail.

A bridge may be classified as a simple span, a continuous span or a combination of simple, continuous span. The classification is based on the arrangement of the bridge's structural components. The basic structural components are the support structures and spans. The support structures are abutments (end-bents) and piers (interior bents). A span is a segment of a bridge that crosses from one support structure to the next; that is, from abutment to abutment, from abutment to pier, from pier to pier or from pier to abutment. A span with structural members that cross only from one support structure to the next support structure is a simple span. A simple span bridge may have several such spans.

A continuous span has structural members that cross from one support structure, over one or more intermediate support structures and to another support structure without a break. The structural members may have to be spliced to obtain the necessary lengths; however, they are considered one-piece members. A continuous span bridge may be made of more than one continuous unit. Additionally, a bridge may be composed of both simple spans and continuous spans and, thus, is a combination of simple, continuous spans.

Referring now to the FIG. 1 a portion of a span 10 of a simple span bridge structure is shown. Span 10 comprises a series of spaced beams or girders 12. The series of spaced girders 12 can comprise three or more laterally spaced girders. In the embodiment as illustrated, there are four girders: first exterior girder 14, first intermediate girder 22, second intermediate girder 30 and second exterior girder 38; however, depending on the width of span 10, more girders may be used. The series of spaced girders are typically spaced apart from about 2 to about 10 feet.

The series of spaced girders 12 has a first end 45 resting upon and supported by pier 46. Series of girders 12 also has a second end, which rests on a second pier or an abutment (the second end and second pier or abutment are not shown). The girders illustrated are I-beams with each girder 14, 22, 30 and 38 having a top flange 16, 24, 32 and 40; a bottom flange 18, 26, 34, and 42; and a web 20, 28, 36 and 44 extending between the top and bottom flange, respectively.

A first diaphragm series 48 and a second diaphragm series 50 extend between the girders to provide structural support. Each diaphragm series comprises a lateral line of one or more diaphragms with each diaphragm extending between a pair of neighboring girders. Generally, these diaphragms will extend from the web of one girder to the web of the next girder.

Although only two diaphragm series are illustrated, it should be understood that the number of diaphragm series depends on the length of the span. The spacing and number of such diaphragm series will be apparent to one skilled in the art. For example, the diaphragm series can be spaced apart approximately ten feet to 20 feet from center to center.

Additionally, there can be lateral struts 51 (see FIG. 3) as further described below. It should be noted that even with the diaphragm series and the lateral struts, the space between girders is substantially free of intervening material or, in other words, the series of spaced girders have substantially no intervening material between adjacent girders. By "substantially no intervening material" it is meant that the majority of space between girders is free from any material or support structures extending between the girders. Generally, 90% or more of the space between girders can be free of any material or support structures and 95% or more of the space between girders can be free of any material or support structures.

The bridge structure has a lateral member extending across the tops of the series of spaced girders 12, shown in the figure as tension rods 52 and 54. Tension rods 52 and 54 are attached to upper flanges 16, 24, 32 and 40 of the girders as part of a lateral bracing structure by a method as further described below. Accordingly, the tension rods extend laterally across the series of spaced girders 12 within a plane parallel to and adjacent to the plane containing the flanges being braced. Tension rod 52 is located between diaphragm series 48 and diaphragm series 50. Tension rod 54 is located between diaphragm series 50 and a third diaphragm series, not shown. Generally, there will be multiple tension rods located between pairs of such diaphragm series so that there is an alternating pattern of tension rods and diaphragm series. For example, if the diaphragm series are spaced apart at 20 foot centers, the tension rods will be spaced apart at 4 foot centers and spaced at 4 foot centers from the neighboring diaphragm series. In additional to tension rods, the tension system can utilize lateral struts 51 extending between bottom flanges 18, 26, 34 and 42 or between the webs of the girders and adjacent to the bottom flanges (see FIG. 3). The lateral struts will generally be located immediately below the tension rod. The lateral struts in tandem with the tension rod aid in preventing lateral shifts or twisting of the girders.

A decking 56 is illustrated resting on and supported by the top of the girders or upper flanges 16, 24, 32 and 40. Decking 56 will typically be constructed as reinforced concrete slab but timber decks or open-grid steel decks can be used.

Figure 2:
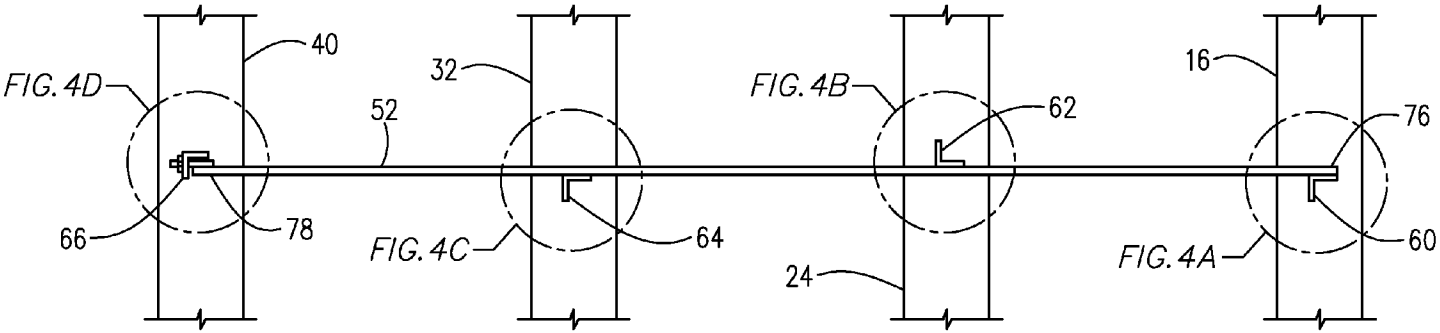
FIG. 2 is a schematic top view of the lateral bracing structure.
Figure 3:
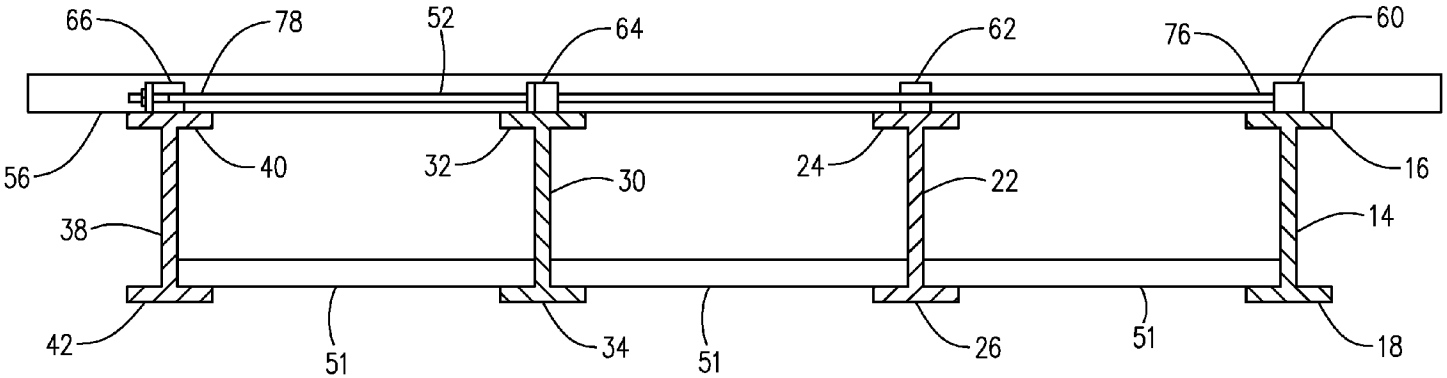
FIG. 3 is a schematic front view of the lateral bracing structure with a bottom bracing strut.
Figure 4A:
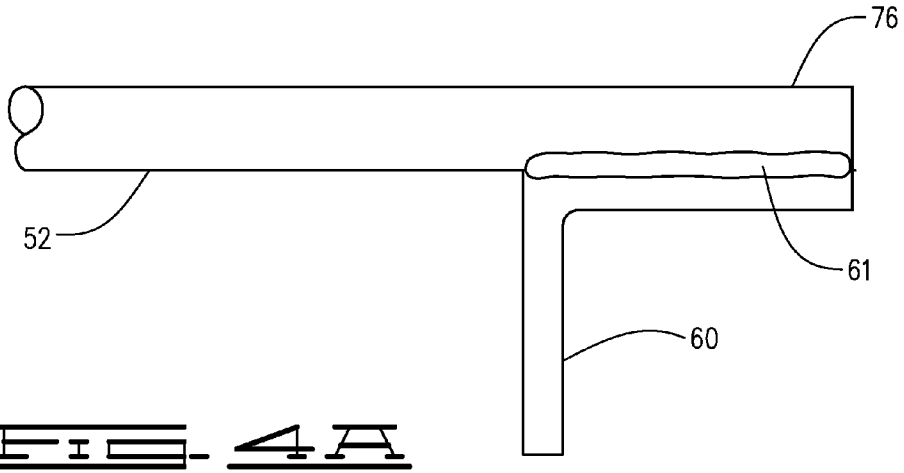
FIG. 4A is a schematic enlargement of the attachment for the first exterior girder portion indicated in FIG. 2
Figure 4B:
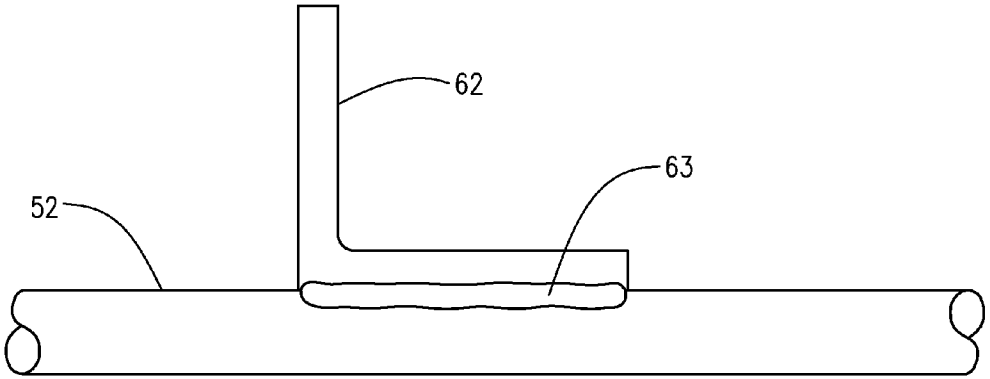
FIG. 4B is a schematic enlargement of the attachment for the first intermediate girder portion indicated in FIG. 2
Figure 4C:
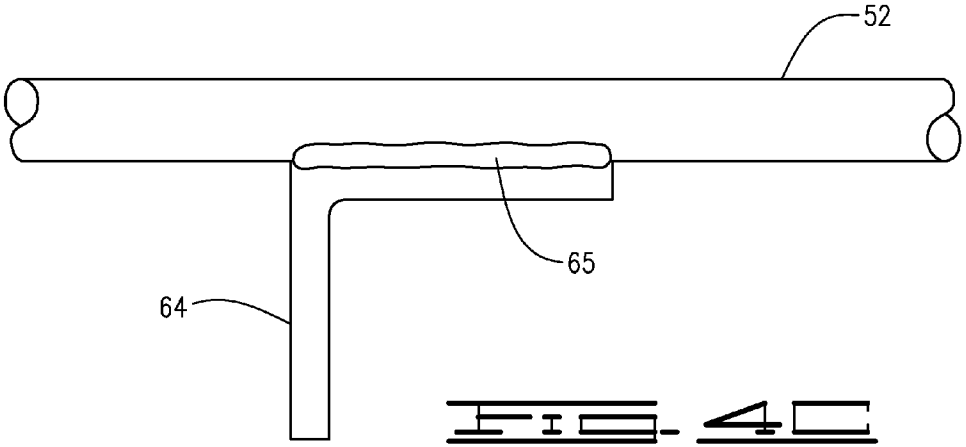
FIG. 4C is a schematic enlargement of the attachment for the second intermediate girder portion indicated in FIG. 2.
Figure 4D:
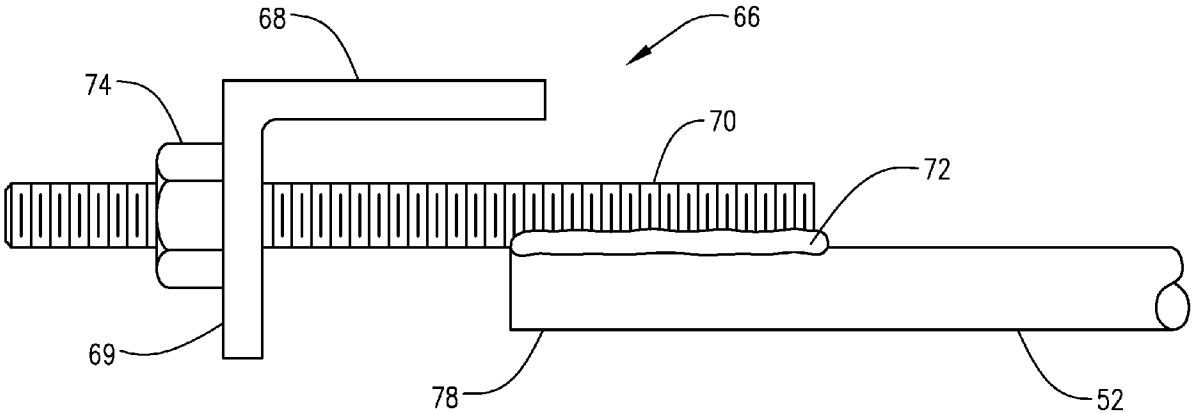
FIG. 4D is a schematic enlargement of the attachment for the exterior girder portion indicated in FIG. 2.

Turning now to FIGS. 2 through 4, one embodiment of the lateral bracing structure utilizing a lateral member for bracing will be further described with reference to tension rod 52. FIG. 2 illustrates a schematic top view of the lateral bracing structure attached to flanges 16, 24, 32 and 40. FIG. 3 is a schematic front view of the lateral bracing structure with a bottom bracing strut 58. FIG. 4A is a schematic enlargement of the portion indicated in FIG. 2 illustrating the attachment for the first exterior girder 14. FIG. 4B is a schematic enlargement of the portion indicated in FIG. 2 illustrating the attachment of the bracing structure to the first intermediate girder 22. FIG. 4C is a schematic enlargement of the portion indicated in FIG. 2 illustrating the attachment of the bracing structure for the second intermediate girder 30. FIG. 4D is a schematic enlargement of the portion indicated in FIG. 2 illustrating the attachment of the bracing structure to the last girder or second exterior girder 38.

As can be seen from the figures, tension rod 52 is attached or affixed to top flange 16 of first exterior girder 14 by an angle bracket 60. Angle bracket 60 can be welded or otherwise securely attached to the top of flange 16. Typically angle bracket 60 will be placed at the center of the width of the top of flange 16. Tension rod 52 is in turn attached or affixed to angle bracket 60 by welding (weld line 61). Similarly, tension rod 52 is attached (weld lines 63 and 65) to flanges 24 and 32 of first intermediate girder 22 and second intermediate girder 30 by angle brackets 62 and 64, respectively. Angle brackets 62 and 64 can be welded or otherwise securely attached on top of flanges 24 and 32, respectively. Tension rod 52 is in turn attached or affixed to angle brackets 62 and 64 by welding (weld lines 63 and 65). If angle brackets are used for the attachment of tension rod 52 to the flanges then generally they will be positioned so that they alternate sides of tension rod 52 as can be seen from FIGS. 2 and 3. It should be understood that other attachments can be used in place of the angle brackets. For example, attachment plates can be used, especially in place of interior angle brackets 62 and 64.

Tension rod 52 is connected to flange 40 of second exterior girder 38 by an adjustable mount 66. Adjustable mount 66 can be any suitable mount that can attach to flange 40 and to tension rod 52 such that the tension in tension rod 52 can be adjusted, at least during installation of tension rod 52. As illustrated, adjustable mount 66 comprises an angle bracket 68 having a hole in L-portion 69 for receiving a threaded lateral member 70. Angle bracket 68 is welded or otherwise securely attached to the top of flange 40. Threaded lateral member 70 is shown as welded (weld line 72) to tension rod 52; however, it can otherwise be attached to or be formed as an integral part of tension rod 52. Adjustable mount 66 further comprises a nut 74, which threadingly engages threaded lateral member 70. Nut 74 is on the opposite side of L-portion 69 from tension rod 52 such that nut 74 contacts L-portion 69 and turning nut 74 will increase the tension on tension rod 52.

As can be seen, the above bracing system connects the lateral bracing directly to the flanges as opposed to being connected to or through the girder web. Connecting directly to the flange provides a direct load path that improves the structural efficiency.

The installation of the above tension bracing system can be carried out by attaching an adjustable mount 66 to the top of flange 40 of girder 38 and attaching an angle bracket to the top of the other girders in the series of laterally spaced girders 12. Next, a first end 76 of the tension rod 52 is attached to the angle bracket 60 on top flange 16 of first exterior girder 14 such that the tension rod 52 extends across the series of spaced girders 12 and can engage the adjustable mount 66. The tension rod preferably does not protrude through the girders. Following the attachment of the first end of the tension rod 52, the second end 78 of the tension rod is engaged with adjustable mount 66. Thereafter, the adjustable mount is adjusted to apply a predetermined tension to the tension rod. Once the predetermined tension has been applied, the tension rod is attached to the angle brackets on the intermediate girders in the series of spaced girders 12. Also, once the predetermined tension has been applied to the tension rod 52, the tension rod 52 or adjustable mount 66 can be fixed so as to prevent further adjustment of the tension by the adjustable mount. For example, nut 74 can be welded into place. Generally, before applying the predetermined tension, the girders can be braced at or adjacent to the bottom of the girders by installing a lateral strut extending between adjacent girders.

In accordance with the above description, various embodiments of the invention will now be further described. In one embodiment there is a method of tension bracing a bridge comprising:

(a) attaching a first end of a lateral member to a first girder in a series of spaced girders having a first girder, a last girder and at least one intermediate girder spaced laterally between the first girder and the last girder, wherein each girder has a top for supporting a decking and a bottom;

(b) attaching an adjustable mount to the last girder wherein the adjustable mount engages a second end of the lateral member such that tension can be applied to the lateral member;

(c) adjusting the adjustable mount to apply a predetermined tension to the lateral member; and (d) attaching the lateral member to each of the intermediate girders.

The above method can further comprise fixing the lateral member so as to prevent further adjustment of the tension by the adjustable mount after the predetermined tension is applied to the lateral member. Additionally in the method, the lateral member can be attached at or adjacent the top of each of the spaced girder so that it extends across the tops and does not protrude through the girders.

Further, the bridge can be a simple span bridge and the series of spaced girders in the method can have substantially no intervening material between adjacent girders except for at least two diaphragm series extending between the girders to provide structural support. The lateral member can be located between two of the diaphragm series. Also, the method can provide for bracing the girders at or adjacent the bottom by a strut extending between adjacent girders. The strut can be located vertically below the lateral member.

In a further embodiment of the method, the adjustable mount can provide for adjustment of the tension of the lateral member by rotational adjustment of the adjustable mount.

In another embodiment, the method of tension bracing a bridge comprises:

(a) attaching an angle bracket to each girder in a series of spaced girders, the series having a first girder, a last girder and at least one intermediate girder spaced laterally between the first girder and the last girder, wherein each girder has a top for supporting a decking and a bottom, the series of spaced girders are spaced apart from 2 feet to 10 feet and the series of spaced girders have substantially no intervening material between adjacent girders and wherein the angles brackets are attached at the center of the top of each girder (b) attaching a first end of a lateral member to the angle bracket attached to the first girder wherein the lateral member extends across the tops of the series of spaced girders and does not protrude through the girders;

(c) engaging a second end of the lateral member to the angle bracket attached to the last girder wherein the angle bracket attached to the last girder has a hole, and the lateral member passes through the hole to thus engage the second end and wherein the second end has a thread defined thereon;

(d) threading a nut onto the second end such that tension is applied to the lateral member;

(e) adjusting the nut to apply a predetermined tension to the lateral member;

(f) attaching the lateral member to the angle brackets at the top of the intermediate girders;

(g) fixing the nut so as to prevent further adjustment of the tension by the adjustable mount after the predetermined tension is applied to the lateral member; and (h) bracing the girders at or adjacent the bottom by a strut extending between adjacent girders.

In another embodiment there is provided a bridge structure comprising a series of spaced girders, an adjustable mount, and a lateral member. The series of spaced girders have a first girder, a last girder, and at least one intermediate girder spaced laterally between the first girder and the last girder. Each girder has a top for supporting a decking and a bottom. The adjustable mount is affixed to the top of the last girder. The lateral member extends across the tops of the series of spaced girders. The lateral member has a first end affixed to the top of the first girder and a second end engaging the adjustable mount such that the adjustable mount can adjust the tension in the lateral member.

In a further embodiment of the bridge structure the tension in the lateral member is adjusted to a predetermined tension and the lateral member is affixed to the top of each intermediate girder. Also, the second end of the lateral member can be affixed from further tension adjustment after the predetermined tension has been set. In one embodiment, the lateral member does not protrude through the girders. Also, the bridge structure can further comprise bracing the girders at or adjacent the bottom by a strut extending between adjacent girders.

In a further embodiment of the bridge structure, the series of spaced girders have substantially no intervening material between adjacent girders. Also, the bridge can be a simple span bridge having at least two diaphragm series extending between the girders to provide structural support and wherein the lateral member is located between two of the diaphragm series.

While various embodiments have been shown and described herein, modifications may be made by one skilled in the art without departing from the spirit and the teachings herein. The embodiments described herein are exemplary only, and are not intended to be limiting. Many variations, combinations, and modifications are possible. Accordingly, the scope of protection is not limited by the description set out above, but is defined by the claims which follow, that scope including all equivalents of the subject matter of the claims.

What is claimed is:

1. A method of tension bracing a bridge comprising:

attaching a first end of a lateral member to a first girder in a series of spaced girders having a first girder, a last girder, and at least one intermediate girder spaced laterally between said first girder and said last girder, wherein each said girder has a top for supporting a decking and a bottom;

attaching an adjustable mount to said last girder wherein said adjustable mount engages a second end of said lateral member such that tension can be applied to said lateral member;

adjusting said adjustable mount to apply a predetermined tension to said lateral member; and attaching said lateral member to each of said intermediate girders, wherein said lateral member is attached at or adjacent said top of each said spaced girder and wherein said lateral member does not protrude through said girders.

2. The method of claim 1 further comprising fixing said lateral member so as to prevent further adjustment of the tension by said adjustable mount after said predetermined tension is applied to said lateral member.

3. The method of claim 1 wherein said lateral member extends across said tops of said series of spaced girders and is attached at said top of each said girder.

4. A method of tension bracing a bridge comprising:

attaching a first end of a lateral member to a first girder in a series of spaced girders having a first girder, a last girder, and at least one intermediate girder spaced laterally between said first girder and said last girder, wherein each said girder has a top for supporting a decking and a bottom;

attaching an adjustable mount to said last girder wherein said adjustable mount engages a second end of said lateral member such that tension can be applied to said lateral member;

adjusting said adjustable mount to apply a predetermined tension to said lateral member; and attaching said lateral member to each of said intermediate girders, wherein said series of spaced girders have substantially no intervening material between adjacent girders.

5. The method of claim 4 wherein said bridge is a simple span bridge having at least two diaphragm series extending between said girders to provide structural support and wherein said lateral member is located between two of said diaphragm series.

6. The method of claim 1 wherein said adjustable mount provides for adjustment of the tension of said lateral member by rotational adjustment of said adjustable mount.

7. The method of claim 1 further comprising bracing said girders at or adjacent said bottom by a strut extending between adjacent girders.

8. The method of claim 6 wherein said girders are I-beam girders spaced apart from 2 feet to 10 feet.

9. A method of tension bracing a bridge comprising:

attaching an angle bracket to each girder in a series of spaced girders, said series having a first girder, a last girder, and at least one intermediate girder spaced laterally between said first girder and said last girder, wherein each said girder has a top for supporting a decking and a bottom, said series of spaced girders are spaced apart from 2 feet to 10 feet and said series of spaced girders have substantially no intervening material between adjacent girders and wherein said angle brackets are attached at the center of said top of each girder;

attaching a first end of a lateral member to said angle bracket attached to said first girder wherein said lateral member extends across said tops of said series of spaced girders and does not protrude through said girders;

engaging a second end of said lateral member to said angle bracket attached to said last girder wherein said angle bracket attached to said last girder has a hole and said lateral member passes through said hole to thus engage said second end and wherein said second end has a thread defined thereon;

threading a nut onto said second end such that tension is applied to said lateral member;

adjusting said nut to apply a predetermined tension to said lateral member;

attaching said lateral member to said angle brackets at said top of said intermediate girders;

fixing said nut so as to prevent further adjustment of the tension by said adjustable mount after said predetermined tension is applied to said lateral member; and bracing said girders at or adjacent said bottom by a strut extending between adjacent girders.

10. A bridge structure comprising:

a series of spaced girders having a first girder, a last girder, and at least one intermediate girder spaced laterally between said first girder and said last girder, wherein each girder has a top for supporting a decking and a bottom;

an adjustable mount affixed to said top of said last girder; and a lateral member extending across said tops of said series of spaced girders, said lateral member having a first end affixed to said top of said first girder and a second end engaging said adjustable mount such that said adjustable mount can adjust the tension in said lateral member.

11. The bridge structure of claim 10 wherein said tension in said lateral member is adjusted to a predetermined tension and said lateral member is affixed to said top of each said intermediate girder.

12. The bridge structure of claim 11 wherein said second end of said lateral member is affixed from further tension adjustment.

13. The bridge structure of claim 10 wherein said series of spaced girders have substantially no intervening material between adjacent girders.

14. The bridge structure of claim 13 wherein said bridge is a simple span bridge having at least two diaphragm series extending between said girders to provide structural support and wherein said lateral member is located between two of said diaphragm series.

15. The bridge structure of claim 10 further comprising bracing said girders at or adjacent said bottom by a strut extending between adjacent girders.

16. The bridge structure of claim 10 wherein said lateral member does not protrude through said girders.

17. The bridge structure of claim 16 wherein said tension in said lateral member is adjusted to a predetermined tension and said lateral member is affixed to said top of each said intermediate girder, wherein said second end of said lateral member is affixed from further tension adjustment and wherein said series of spaced girders have substantially no intervening material between adjacent girders.

18. The bridge structure of claim 17 wherein each said girder has an angle bracket attached at the center of its top, said lateral member is affixed to each said girder by said angle bracket and said angle bracket on said last girder has a hole for engaging said lateral member wherein said lateral member is threaded to receive a nut such that tension can be applied to said lateral member.

* * * * *